US009371602B2

(12) United States Patent
Ueda

(10) Patent No.: US 9,371,602 B2
(45) Date of Patent: Jun. 21, 2016

(54) INDUSTRIAL TWO-LAYER FABRIC

(71) Applicant: NIPPON FILCON CO., LTD., Tokyo (JP)

(72) Inventor: Ikuo Ueda, Shizuoka (JP)

(73) Assignee: NIPPON FILCON CO., LTD., Tokyo (JP)

( * ) Notice: Subject to any disclaimer, the term of this patent is extended or adjusted under 35 U.S.C. 154(b) by 0 days.

(21) Appl. No.: 14/329,324

(22) Filed: Jul. 11, 2014

(65) Prior Publication Data

US 2015/0013821 A1 Jan. 15, 2015

(30) Foreign Application Priority Data

Jul. 12, 2013 (JP) ..... 2013-146050

(51) Int. Cl.
*D03D 11/00* (2006.01)
*D21F 1/00* (2006.01)
*D03D 25/00* (2006.01)

(52) U.S. Cl.
CPC ..... *D03D 11/00* (2013.01); *D21F 1/0045* (2013.01)

(58) Field of Classification Search
CPC ..... D21F 1/0036; D21F 1/0045; D21F 1/80; D03D 11/00; D03D 1/0094
See application file for complete search history.

(56) References Cited

U.S. PATENT DOCUMENTS

| | | | | |
|---|---|---|---|---|
| 7,073,539 | B2 * | 7/2006 | Takimoto et al. | 139/383 A |
| 7,216,677 | B2 * | 5/2007 | Fujisawa | 139/383 A |
| 7,270,151 | B2 * | 9/2007 | Nagura et al. | 139/383 A |
| 7,270,152 | B2 * | 9/2007 | Ueda et al. | 139/383 A |
| 7,306,014 | B2 * | 12/2007 | Nagura et al. | 139/383 A |
| 7,343,938 | B2 * | 3/2008 | Takimoto | 139/383 A |
| 7,357,156 | B2 * | 4/2008 | Ueda et al. | 139/383 A |
| 7,357,157 | B2 * | 4/2008 | Ueda | 139/383 A |
| 7,412,991 | B2 * | 8/2008 | Takimoto et al. | 139/383 A |
| 7,426,943 | B2 * | 9/2008 | Ueda et al. | 139/383 A |
| 7,464,731 | B2 * | 12/2008 | Fujisawa | 139/383 A |
| 7,819,141 | B1 * | 10/2010 | Ueda | 139/383 A |
| 7,874,321 | B2 * | 1/2011 | Fujisawa | 139/383 A |
| 7,874,322 | B2 * | 1/2011 | Ueda | 139/383 A |
| 7,882,857 | B1 * | 2/2011 | Ueda | 139/383 A |
| 7,896,035 | B2 * | 3/2011 | Ueda et al. | 139/383 A |

(Continued)

FOREIGN PATENT DOCUMENTS

| | | |
|---|---|---|
| EP | 1659212 A2 | 5/2006 |
| EP | 1662039 A1 | 5/2006 |

(Continued)

OTHER PUBLICATIONS

Extended Search Report issued in European Application No. 14176447.2, dated Nov. 17, 2014.

*Primary Examiner* — Bobby Muromoto, Jr.
(74) *Attorney, Agent, or Firm* — Michael Best and Friedrich

(57) ABSTRACT

An industrial two-layer fabric of 16 or more shafts consists of an upper side fabric having upper side warps and upper side wefts and a lower side fabric having lower side warps and lower side wefts, the upper side fabric and the lower side fabric are bound by binding yarns. A first warp pair consists of a binding yarn and one of an adjacent upper side warp, an adjacent lower side warp and an adjacent binding yarn. A second warp pair consists of an upper side warp and an adjacent lower side warp. In a complete design, two or more of the first warp pairs are placed adjacent to each other, and two or more of the second warp pairs are placed adjacent to each other.

12 Claims, 9 Drawing Sheets

(56) References Cited

U.S. PATENT DOCUMENTS

| | | | | |
|---|---|---|---|---|
| 8,205,644 | B2 * | 6/2012 | Ueda | 139/383 A |
| 2005/0224130 | A1 * | 10/2005 | Takimoto et al. | 139/408 |
| 2006/0040578 | A1 * | 2/2006 | Nagura et al. | 442/239 |
| 2006/0102244 | A1 * | 5/2006 | Ueda et al. | 139/383 A |
| 2006/0112999 | A1 * | 6/2006 | Nagura et al. | 139/383 A |
| 2006/0116042 | A1 * | 6/2006 | Nagura et al. | 442/205 |
| 2006/0260708 | A1 * | 11/2006 | Ueda et al. | 139/383 A |
| 2006/0278295 | A1 * | 12/2006 | Ueda et al. | 139/383 A |
| 2006/0278297 | A1 * | 12/2006 | Ueda | 139/383 A |
| 2007/0095417 | A1 * | 5/2007 | Fujisawa | 139/383 A |
| 2007/0128414 | A1 * | 6/2007 | Nakajima | 428/194 |
| 2009/0205740 | A1 * | 8/2009 | Quigley | 139/408 |
| 2010/0119787 | A1 * | 5/2010 | Ueda et al. | 428/196 |
| 2010/0132825 | A1 * | 6/2010 | Fujisawa | 139/413 |
| 2010/0196670 | A1 * | 8/2010 | Ueda | 428/172 |
| 2010/0221499 | A1 * | 9/2010 | Ueda | 428/172 |
| 2010/0252137 | A1 * | 10/2010 | Ueda | 139/413 |
| 2011/0011485 | A1 * | 1/2011 | Ueda | 139/383 A |
| 2015/0013821 | A1 * | 1/2015 | Ueda | 139/409 |

FOREIGN PATENT DOCUMENTS

| | | | |
|---|---|---|---|
| EP | 1734177 | A1 | 12/2006 |
| JP | 2001-098483 | A | 4/2001 |
| JP | 2003-342889 | A | 12/2003 |

* cited by examiner

Related Art

INDUSTRIAL TWO-LAYER FABRIC

BACKGROUND OF THE INVENTION

1. Field of the Invention

The present invention relates to an industrial two-layer fabric having a warp binding yarn, in particular, an industrial two-layer fabric featuring reduced internal abrasion, less dehydration marks, and excellent surface smoothness.

2. Background Art

Industrial fabrics obtained by weaving warps and wefts have conventionally been used widely. They have been used as, for example, papermaking fabrics, conveyor belts, and filter cloths and required to have fabric characteristics suited for intended uses or using environments, respectively. Of such fabrics, papermaking fabrics used in a papermaking step to dehydrate raw materials by making use of the screen of the fabrics should satisfy a severe demand. There is therefore a demand for the development of, for example, fabrics which are excellent in surface smoothness and therefore do not transfer a dehydration mark of the fabrics to paper; or fabrics having a dehydration property which permits sufficient and uniform removal of extra water contained in the raw materials, having enough rigidity and abrasion resistance to enable desirable use of them even under severe environments, and further capable of maintaining conditions necessary for making good paper for a prolonged period of time. In addition, papermaking fabrics have been required to have a fiber supporting property, an improved paper making yield, dimensional stability, running stability, and the like. Further, due to the speed-up of a paper making machine in recent years, requirements for papermaking fabrics become more severe.

Demands for most of the existing industrial fabrics and solutions thereof can be understood from a description on papermaking fabrics on which the most severe demand is imposed among industrial fabrics. Therefore, a description will next be made with papermaking fabrics as an example.

It is known that while an industrial two-layer fabric obtained by bringing together an upper side fabric and a lower side fabric with a binding yarn travels on a papermaking machine, there occurs abrasion at a position where the upper side fabric is brought into contact with the lower side fabric.

Particularly, with a recent increase in the speed of a papermaking machine, internal abrasion occurs more frequently. The internal abrasion causes fluffing of the surface of the yarns inside the fabric and this deteriorates the airflow degree of the mesh, resulting in reduction in dehydration rate.

As a method of preventing such internal abrasion, there is known a method of enhancing adhesion between an upper side fabric and a lower side fabric. As a method of enhancing adhesion between an upper side fabric and a lower side fabric, there is, for example, a method of widening the diameter of binding yarns or increasing the number of binding yarns (refer to Japanese Patent Laid-Open No. 2001-98483). For example, by increasing the number of binding yarns and thereby increasing a binding ratio in a complete design or a repeating unit of a fabric, improvement in adhesion can be achieved due to an increase in the number of yarns binding an upper side fabric and a lower side fabric.

When the binding ratio is increased by the above-mentioned method, however, a dehydration mark is likely to appear in the upper side fabric. This means that an industrial two-layer fabric that includes a warp binding yarn has conventionally a structure in which an upper side warp does not form a knuckle on an upper side fabric at a site where it is supposed to form and, instead, a lower side warp (a binding yarn) forms a knuckle on the upper side fabric (refer to Japanese Patent Laid-Open No. 2003-342889). At such a site where the knuckle of an upper side warp is made up for by the lower side warp, a substantial warp density doubles in the upper side because of the presence of the upper side warp which is out of the original arrangement. When the warp density increases at a site, the site becomes a dehydration inhibition site. When the number of binding yarns is increased and thereby a binding ratio is increased in a fabric having such a structure, the resulting fabric has uniformly-arranged dehydration inhibition sites. These sites constitute a dehydration inhibition line depending on the arrangement shape of the dehydration inhibition sites. As a result, paper made using such a fabric has on the surface thereof dehydration marks.

In order to prevent an increase in the density of dehydration inhibition sites due to binding yarns, there may be a method of increasing the number of wefts in the complete design or the repeating unit and thereby lengthening the long longitudinal direction in the complete design. Such a structure can reduce the density of the dehydration inhibition sites. On the other hand, when such a structure is employed for a conventional design, one binding yarn continuously forms a plurality of knuckles on an upper side fabric.

It is known that in a design in which one binding yarn continuously forms a plurality of knuckles on an upper side fabric, the resulting fabric has a convex shape with the center of the continuous knuckles as a peak.

For example, in FIG. 1A, a warp (binding yarn) 1 passes over a weft 1', passes under a weft 2' and passes over a weft 3' and forms knuckles on an upper side fabric at the wefts 1' and 3'. In such a weave structure, a stress is applied to the fabric according to the tension of the warp (binding yarn) 1 in a direction of an arrow so that a convex shape with the weft 2' located at the center position as a peak is formed. In FIG. 1B, a warp (binding yarn) 2 passes over wefts 1' and 2', under wefts 3' and 4', over wefts 5' and 6', under wefts 7' and 8' and over wefts 9' and 10' and forms knuckles on an upper side fabric at wefts 1' and 2', 5' and 6' and 9' and 10'. In such a weave structure, a stress is applied to the fabric according to the tension of the warp (binding yarn) 2 in a direction of the arrows so that a convex shape with wefts 5' and 6' located at the center portion as a peak is formed. Further, in FIG. 1C, a warp (binding yarn) 3 passes over wefts 1', 5', 9', and 13' and passes under other wefts and forms a knuckle on an upper side fabric at the wefts 1', 5', 9', and 13'. In such a weave structure, a stress is applied to the fabric according to the tension of the warp (binding yarn) 3 in a direction of the arrows so that a convex shape with the weft 7' and the neighboring wefts located at the center position as a peak is formed.

Uniform arrangement of convex sites as described above becomes a cause of not only dehydration marks but also a cause of deteriorating the surface smoothness of the fabric.

The existing industrial two-layer fabrics have the above-mentioned problems, but these problems can be overcome by decreasing a binding ratio. Decreasing a binding ratio, however, deteriorates the adhesion between an upper side fabric and a lower side fabric as described above and thereby causes internal abrasion. This suggests that there is a trade-off relationship between a binding ratio and adhesion.

There has been no design capable of satisfying all the required characteristics such as internal abrasion, dehydration mark, and surface smoothness.

SUMMARY OF THE INVENTION

An object of the invention is to provide an industrial two-layer fabric capable of suppressing internal abrasion, causing less dehydration marks, and excellent in surface smoothness and drainage property.

An industrial two-layer fabric of 16 or more shafts of the present invention consists of an upper side fabric having upper side warps and upper side wefts and a lower side fabric having lower side warps and lower side wefts. The upper side fabric and the lower side fabric are bound by binding yarns. A first warp pair of the fabric consists of a binding yarn and one of an adjacent upper side warp, an adjacent lower side warp and an adjacent binding yarn. A second warp pair of the fabric consists of an upper side warp and an adjacent lower side warp. In a complete design of the fabric, two or more of the first warp pairs are placed adjacent to each other, and two or more of the second warp pairs are placed adjacent to each other.

A first binding yarn of one of the first warp pairs may form consecutive knuckles on the upper side fabric at a first site with a first group of upper side wefts. A second binding yarn of another one of the first warp pairs adjacent to the one of the first warp pairs may form consecutive knuckles on the upper side fabric at a second site with a second group of upper side wefts. One of the upper side wefts at an end of the second group may be one of the upper side wefts at or adjacent to a center of the first group.

Alternatively, a first binding yarn of one of the first warp pairs may form consecutive knuckles on the upper side fabric at a first site with a first group of upper side wefts, a second binding yarn of another one of the first warp pairs adjacent to the one of the first warp pairs may form a knuckle with one of the upper side wefts at or adjacent to a center of the first group. One of the upper side wefts that forms the knuckle may be one of the upper side wefts at or adjacent to a center of the first group.

The first warp pair may consist of the two binding yarns.

One of the first warp pairs may consist of the two binding yarns, and another one of the first warp pairs adjacent to the one of the first warp pairs may consist of the binding yarn and either one of the adjacent upper side warp and the adjacent lower side warp.

In the two or more first warp pairs placed adjacent to each other, all the warps constituting the first warp pairs may be binding yarns.

The invention is effective for providing an industrial two-layer fabric capable of suppressing internal abrasion of an industrial two-layer fabric and at the same time, reducing dehydration marks. In addition, the invention is effective for providing an industrial two-layer fabric excellent in surface smoothness and drainage.

BRIEF DESCRIPTION OF THE DRAWINGS

FIGS. 16A and 16B each shows a surface transfer mark of an upper side surface of the industrial two-layer fabrics according to Comparative Example 1 and Embodiment 4, respectively, in which FIG. 16A is an upper side surface of the industrial two-layer fabric according to Comparative Example 1 and FIG. 16B is an upper side surface of the industrial two-layer fabric according to Embodiment 1.

DESCRIPTION OF THE PREFERRED EMBODIMENTS

The industrial two-layer fabric according to the invention will hereinafter be described in detail.

In the industrial two-layer fabric according to the invention, the complete design has, supposing that an upper side warp and a lower side warp adjacent thereto constitute a pair, four or more first warp pairs, each having, as at least one of the warps, a warp binding yarn having a function of joining the upper side fabric and the lower side fabric and four or more second warp pairs, each having no warp binding yarn. In this complete design, two or more of the first warp pairs and two or more of the second warp pairs are placed adjacent to each other, respectively. The complete design in the industrial two-layer fabric according to the invention has 16 shafts or greater.

The first warp pair is obtained using two warps in combination. At least one of these two warps should be a warp binding yarn. Of course, the first warp pair may be made of two warp binding yarns. In addition, the invention is characterized by that two or more of the first warp pairs are placed adjacent to each other in the complete design.

In the two or more of the first warp pairs placed adjacent to each other, all the warps constituting the first warp pairs may be a binding yarn. Alternatively, both the warps of one of the first warp pairs may be a binding yarn and either one of the warps of another first warp pair may be a binding yarn.

Placing the first warp pairs adjacent to each other in one complete design and placing, between two groups of the two or more of the first warp pairs placed adjacent to each other, a second warp pair having no warp binding yarn make it possible to improve adhesion between the upper side fabric and the lower side fabric and at the same time, suppress internal abrasion. In addition, placing two or more of the second warp pairs not containing a warp binding yarn adjacent to each other makes it possible to improve a drainage property. In short, the industrial two-layer fabric according to the invention having the above-mentioned constitution can have reduced internal abrasion and thereby have improved abrasion resistance inside the fabric and at the same time, have an improved dehydration property.

Second Embodiment of the complete design in the industrial two-layer fabric according to the invention is characterized by that the two or more first warp pairs placed adjacent to each other have sites at which at least one of the binding yarn(s) constituting one of the first warp pairs continuously forms a plurality of knuckles on the upper side fabric and they have, at a site adjacent to the above-mentioned sites, a non-continuous single knuckle of the binding yarn of another first warp pair adjacent to the one of the first warp pairs or an end portion of a continuous plurality of knuckles of the binding yarn of the another first warp pair adjacent to the one of the first warp pairs.

Figure 1A:
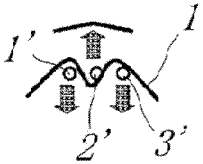
FIGS. 1A, 1B and 1C are schematic views of a fabric that includes a convex shape with a center portion of two or more continuous knuckles as a peak.
Figure 1B:
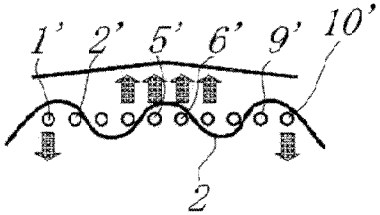
Figure 1C:
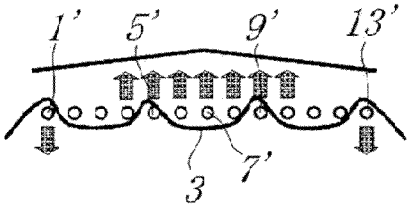

In a weave structure as shown in FIG. 1, at a portion having knuckles on an upper side fabric, a convex appears at the center portion of the knuckles and a concave appears at the end portion of the knuckles. Thus, a convex and concave shape is formed. Such a fabric structure cannot achieve surface smoothness which is a characteristic necessary for fabrics.

At a site where at least one of the binding yarn(s) constituting the first warp pair continuously forms a plurality of knuckles on an upper side fabric, a convex shape with a weft located at the center of the knuckles as a peak is formed. At a site where such a convex shape may appear, another first warp pair is placed. A weave structure is formed so as to place, at a site where one of the first warp pairs forms a convex shape, a single knuckle of another first warp pair adjacent to the one of the first warp pairs or an end portion of a continuous plurality of knuckles of the another first warp pair adjacent to the one of the first warp pairs.

By employing such a weave structure, the concave and convex shape which has appeared in the first warp pairs can be offset by making use of a stress relationship between these first warp pairs adjacent to each other. This makes it possible to prevent transfer of a dehydration mark of the fabric to paper and achieve good surface smoothness.

A yarn to be used in the present embodiment may be selected depending on its intended use. Examples of the yarns include, in addition to monofilaments, multi-filaments, spun yarns, finished yarns subjected to crimping or bulking such as so-called textured yarn, bulky yarn, and stretch yarn and yarns obtained by intertwining them. As the cross-section of the yarn, not only circular shape but also square shape, short shape such as stellar shape, elliptical shape, or hollow shape can be used. The material of the yarn can be selected freely and usable examples of it include polyester, polyamide, polyphenylene sulfide, polyvinylidene fluoride, polypropylene, aramid, polyether ether ketone, polyethylene naphthalate, polytetrafluoroethylene, cotton, wool and metal. Of course, yarns obtained using copolymers or incorporating or mixing, in or with the above-described material, a substance selected depending on the using purpose may be used. As a papermaking wire, it is generally preferred to use a polyester monofilament having rigidity and excellent dimensional stability for upper side warps, lower side warps, lower warp binding yarns, and upper side wefts. On the other hand, as lower side wefts required to have abrasion resistance, those obtained by interweaving, for example, alternately arranged polyester monofilaments and polyamide monofilaments are preferred because yarns obtained in such a manner have improved abrasion resistance without losing rigidity.

Embodiments of the industrial two-layer fabric according to the invention will next be described. Embodiments shown below are only examples of the invention and do not limit the invention.

Embodiments of the industrial two-layer fabric according to the invention will be described referring to drawings. FIGS. 2 to 13 are design diagrams showing Embodiments 1 to 16 of the industrial two-layer fabric of the invention. The term "design diagram" means a minimum repeating unit of a fabric pattern and this repeating unit (also called as a "complete design") is horizontally and perpendicularly connected to each other to form the entire fabric pattern. In the design diagram, warps are indicated by Arabic numerals, for example, 1, 2, 3 . . . . In the present embodiment, there are a first warp pair having, as at least one of the warps thereof, a warp (b) having a binding function and a second warp pair not having a warp binding yarn (b) and made of an upper side warp and a lower side warp. Wefts are indicated by Arabic numerals with prime, for example, 1', 2', 3' . . . . Depending on an arrangement ratio, there are cases where an upper side weft and a lower side weft are placed perpendicularly and cases where only an upper side weft is placed. The symbol "X" shows that an upper side warp is located over an upper side weft; the symbol "▲" shows that a lower side warp binding yarn is located over an upper side weft; the symbol "■" shows that an upper side warp binding yarn is located over an upper side weft; the symbol "○" shows that a lower side warp is located under a lower side weft; the symbol "Δ" shows that a lower side binding yarn is located under a lower side weft; and the symbol "□" shows that an upper side warp binding yarn is located under a lower side weft.

An upper side warp and a lower side warp, and an upper side weft and a lower side weft sometimes perpendicularly overlap with each other. With regard to wefts, an upper side weft sometimes does not have a lower side weft thereunder, which depends on an arrangement ratio. According to the design diagram, yarns are placed perpendicularly while being overlapped exactly for convenience of the diagram, but they may be misaligned in actual fabrics.

Embodiment 1

Figure 2:
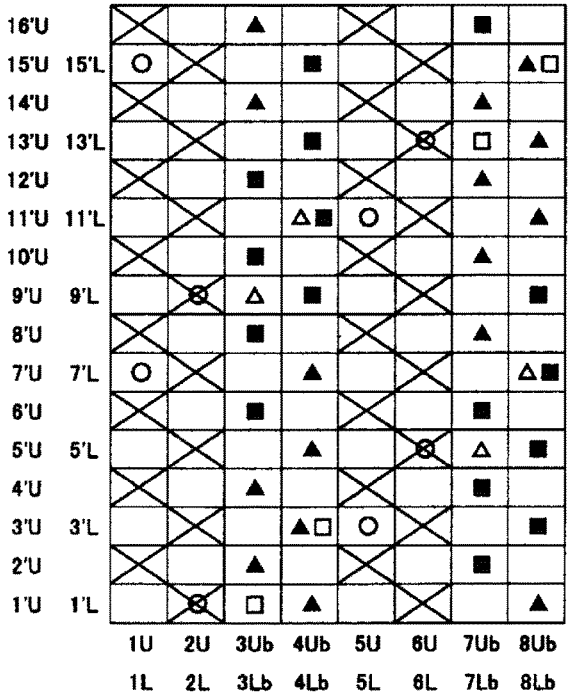
FIG. 2 is a design diagram showing a complete design or a repeating unit of Embodiment 1 according to an industrial two-layer fabric of the invention.

FIG. 2 is a design diagram showing a complete design or a repeating unit of Embodiment 1 according to the industrial two-layer fabric of the invention. The complete design has second warp pairs having no warp binding yarn and made of upper side warps (1U, 2U, 5U, and 6U) and lower side warps (1L, 2L, 5L, and 6L). Each of the upper side warps and each of the lower side warps of the second warp pairs having the same number are vertically arranged adjacent to each other and form the second warp pairs (1U, 1L), (2U, 2L), (5U, 5L) and (6U, 6L).

The complete design also has first warp pairs that consist of upper side warp binding yarns (3Ub, 4Ub, 7Ub, and 8Ub) and lower side warp binding yarns (3Lb, 4Lb, 7Lb, and 8Lb) each having a binding function. Each of the upper side warp binding yarns and each of the lower side warp binding yarns of the first warp pairs having the same number, are arranged adjacent to each other and form the first warp pairs (3Ub, 3Lb), (4Ub, 4Lb), (7Ub, 7Lb) and (8Ub, 8Lb).

Of the first warp pairs, two pairs, namely, a pair of 3Ub and 3Lb and a pair of 4Ub and 4Lb are adjacent to each other and another two pairs, namely, a pair of 7Ub and 7Lb and a pair of 8Ub and 8Lb are adjacent to each other. Thus, the complete design has four first warp pairs. In the second warp pairs, two pairs, namely, a pair of 1U and 1L and a pair of 2U and 2L are adjacent to each other and another two pairs, namely, a pair of 5U and 5L and a pair of 6U and 6L are adjacent to each other. Thus, the complete design has four second warp pairs. As shown in FIG. 2, two first warp pairs and two second warp pairs are alternately arranged and constitute a fabric having 16 shafts in total. The arrangement ratio of upper side wefts and lower side wefts is 2:1.

An upper side fabric forms a 1/1 design (plain weave design) in which each warp alternately goes over and under each upper side weft. The warp binding yarn of the first warp pair is a warp having a binding function and it binds an upper side fabric and a lower side fabric by weaving an upper side weft and a lower side weft. The upper side warp and the lower side warp of the second warp pair, on the other hand, are warps having no binding function.

Figure 3A:
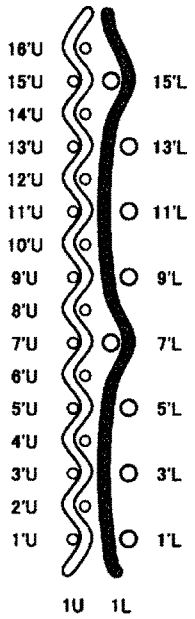
FIGS. 3A-3C are cross-sectional schematic views in a warp direction of Embodiment 1 shown in FIG. 2.
Figure 3B:
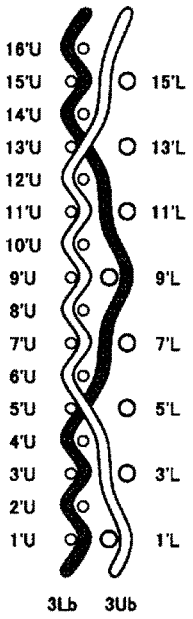
Figure 3C:
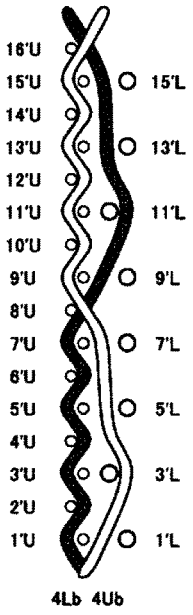

Described specifically, as shown in FIG. 3A, upper side warp 1U of the two warps of the second warp pair (1U, 1L) goes under upper side weft 1'U, goes over upper side weft 2'U, goes under upper side weft 3'U, goes over upper side weft 4'U, goes under upper side weft 5'U, and so on to form a plain weave. Lower side warp 1L goes under lower side wefts 7'L and 15'L. Next, as shown in FIG. 3B, lower side warp binding yarn 3Lb of the two warps of the first warp pair (3Ub, 3Lb) goes over none of upper side wefts 6'U, 8'U, 10'U, and 12'U over which it is supposed to go from the standpoint of the constitution of the plain weave but go between upper side wefts 5'U, 6'U, 7'U, and 8'U and lower side wefts 5'L and 7'L, go under lower side weft 9'L, go between upper side wefts 10'U, 11'U, 12'U, and 13'U and lower side wefts 11'L and 13'L, and then go over upper side wefts 14'U and 16'U. On the other hand, upper side warp binding yarn 3Ub goes over upper side wefts 6'U, 8'U, 10'U, and 12'U over which lower side warp binding yarn 3Lb is supposed to go, and go under lower side weft 1'L to form a plain weave design. These binding warps together constitute a design corresponding to one warp (an upper side warp or a lower side warp). Another first warp pair (4Ub, 4Lb) placed adjacent to the first warp pair (3Ub, 3Lb), as shown in FIG. 3C, forms a plain weave design similar thereto but shifted by three upper side wefts. More specifically, it forms a plain weave design in which upper side warp binding yarn 4Ub goes over upper side wefts 9'U, 11'U, 13'U, and 15'U and go under lower side weft 3'L.

In this Embodiment 1, as shown in FIG. 3B, the first warp pair (3Ub, 3Lb) has a first continuous knuckle site where the upper side warp binding yarn (3Ub) consecutively forms a plurality of knuckles on the upper side fabric with upper side wefts 6'U, 8'U, 10'U and 12'U (shown as the symbols "■" in FIG. 2) of a first group of upper side wefts 6'U through 12'U having a center upper side weft 9'U and end upper side wefts 6'U and 12'U.

Another first warp pair (4UB, 4Lb) which is adjacent to the first warp pair above (3Ub, 3Lb) forms, as shown in FIG. 3C, consecutive knuckles on the upper side fabric at second continuous knuckle site where the upper side warp binding yarn (4Ub) consecutively forms a plurality of knuckles on the upper side fabric with upper side wefts 9'U, 11'U, 13'U and 15'U (shown as the symbols "■" in FIG. 2) of a second group of upper side wefts 9'U through 15'U having an end upper side weft 9'U having a center upper side weft 12'U and end upper side wefts 9'U and 15'U.

At another second continuous knuckle site, the lower side warp binding yarn (4Lb) consecutively forms a plurality of knuckles on the upper side fabric with upper side wefts 1'U, 3'U, 5'U and 7'U (shown as the symbols "▲" in FIG. 2) of another second group of upper side wefts 1'U through 7'U having a center upper side weft 4'U and end upper side wefts 1'U and 7'U.

The end upper side weft 9'U of the second group is the center upper side weft 9'U of the first group.

As shown in FIGS. 3B and 3C, when such a structure is employed, a stress in the first warp pair (3Ub and 3Lb) is applied in an upward direction at upper side weft 9'U as a peak (see weft 2' of FIG. 1A) but in the warps of the first warp pair (4Ub and 4Lb) adjacent to the above-mentioned first warp pair, a stress is applied in a downward direction at upper side wefts 7'U and 9'U (see wefts 1' and 3' of FIG. 1A) so that the concave and convex thus formed can be offset by such a stress relationship between them.

Also, a downward stress formed by lower side binding yarn 3Lb and upper side binding yarn 3Ub at end upper side wefts 4'U and 6'U of FIG. 3B can be balanced by an upward stress formed by lower side binding yarn 4Lb at center upper side weft 4'U of FIG. 3C, so that a convex and a concave thus formed can also be off set. Likewise, a downward stress formed by upper side binding yarn 3Ub and lower side binding yarn 3Lb at end upper side wefts 12'U and 14'U of FIG. 3B can be balanced by an upward stress formed by upper side binding yarn 4Ub at center upper side weft 12'U of FIG. 3C, so that a convex and a concave thus formed can also be off set. This structure of the fabric makes it possible to prevent transfer of a dehydration mark of a fabric to paper and achieve good surface smoothness.

Embodiment 2

Figure 4:
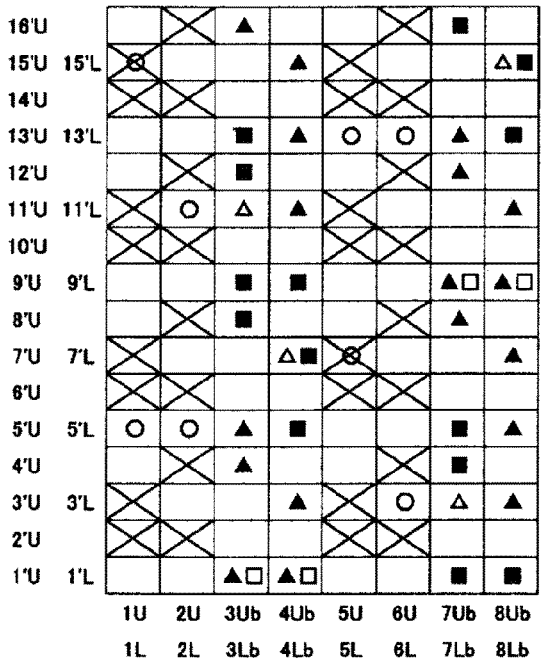
FIG. 4 is a design diagram showing a complete design or a repeating unit of Embodiment 2 according to the industrial two-layer fabric of the invention.

FIG. 4 is a design diagram showing a complete design or a repeating unit of Embodiment 2 according to the industrial two-layer fabric of the invention. The complete design has second warp pairs having no warp binding yarn and made of upper side warps (1U, 2U, 5U, and 6U) and lower side warps (1L, 2L, 5L, and 6L) and first warp pairs made of upper side warp binding yarns (3Ub, 4Ub, 7Ub, and 8Ub) and lower side warp binding yarns (3Lb, 4Lb, 7Lb, and 8Lb) each having a binding function. In the first warp pairs shown in FIG. 4, two pairs, that is, a pair of 3Ub and 3Lb and a pair of 4Ub and 4Lb are adjacent to each other and two pairs, that is, a pair of 7Ub and 7Lb and a pair of 8Ub and 8Lb are adjacent to each other. Thus, the complete design has four first warp pairs. In the second warp pairs, two pairs, that is, a pair of 1U and 1L and a pair of 2U and 2L are adjacent to each other and two pairs, that is, a pair of 5U and 5L and a pair of 6U and 6L are adjacent to each other. Thus, the complete design has four second warp pairs. As shown in FIG. 4, two first warp pairs and two second warp pairs are alternately arranged and constitute a fabric having 16 shafts in total. The arrangement ratio of upper side wefts and lower side wefts is 2:1.

The warp binding yarn of the first warp pair is a warp having a binding function and it binds an upper side fabric and a lower side fabric by weaving with an upper side weft and a lower side weft. The upper side warp and the lower side warp of the second warp pair, on the other hand, are warps having no binding function.

Figure 5A:
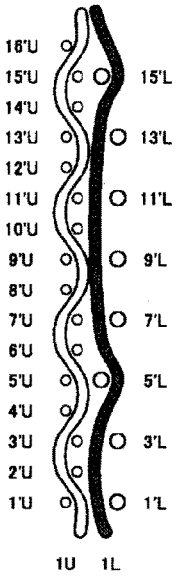
FIGS. 5A-5D are cross-sectional schematic views in a warp direction of Embodiment 2 shown in FIG. 4.
Figure 5B:
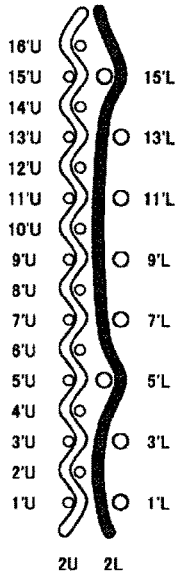

Described specifically, as shown in FIG. 5A, upper side warp 1U of the two warps of the second warp pair (1U, 1L) goes over upper side wefts 2'U and 3'U, goes under upper side wefts 4'U and 5'U, goes on upper side wefts 6'U and 7'U, goes under upper side wefts 8'U and 9'U, and so on. Lower side warp 1L which is arranged adjacent to and below upper side warp 1U, goes under lower side wefts 5'L and 15'L. Upper side warp 2U of the two warps of the second warp pair (2U, 2L), as shown in FIG. 5B, adjacent to the second warp pair (1U, 1L), goes under upper side weft 1'U, goes over upper side weft 2'U, goes under upper side weft 3'U, goes over upper side weft 4'U, goes under upper side weft 5'U, and so on to form a plain weave. Lower side warp 2L, arranged adjacent to and below upper side warp 2U, goes under lower side wefts 5'L and 15'L.

Figure 5C:
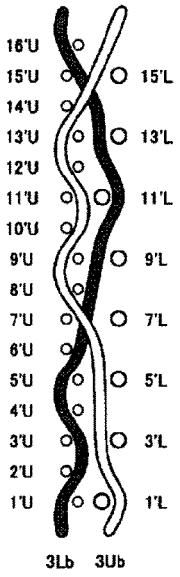
Figure 5D:
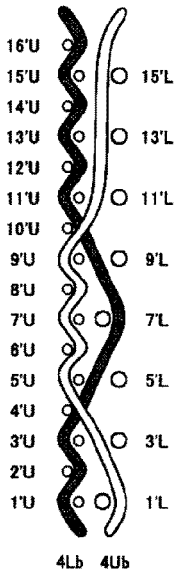

Next, as shown in FIG. 5C, lower side warp binding yarn 3Lb of the two warps of the first warp pair (3Ub, 3Lb) goes over none of upper side wefts 8'U, 9'U, 12'U, and 13'U over which it is supposed to go from the standpoint of the constitution of the fabric but goes under lower side weft 11'L and then goes over upper side wefts 16'U and 1'U. On the other hand, upper side warp binding yarn 3Ub, arranged adjacent to lower side binding yarn 3Lb, goes over upper side wefts 8'U, 9'U, 12'U, and 13'U over which lower side warp binding yarn 3Lb is supposed to go and then go under lower side weft 1'L. As shown in FIG. 5D, lower side warp binding yarn 4Lb of the two warps of another first warp pair (4Ub, 4Lb) placed adjacent to the above-mentioned first warp pair goes over none of upper side wefts 5'U, 7'U, and 9'U over which it is supposed to go from the standpoint of the constitution of a plain weave, goes between upper side weft 5'U and lower side weft 5'L, goes under lower side weft 7'L, goes between upper side weft 9'U and lower side weft 9'L, and then goes over upper side wefts 11'U, 13'U, 15'U, 1'U, and 3'U. On the other hand, upper side warp binding yarn 4Ub, which is arranged adjacent to lower side warp binding yarn 4Lb, goes over upper side wefts 5'U, 7'U, and 9'U over which lower side warp binding yarn 4Lb is supposed to go, and then goes under lower side weft 1'L. These warp binding yarns, together as a pair, form a plain weave design corresponding to one warp.

In this Embodiment 2, the first warp pair (3Ub, 3Lb) has sites (upper side wefts 8'U and 9'U, and 12'U and 13'U) at which the upper side warp binding yarn (3Ub) constituting the first pair continuously forms a plurality of knuckles on the upper side fabric and at a site adjacent to the above-mentioned sites, placed is an end portion (11'U) of a continuous plurality of knuckles of the binding yarn of the first warp pair (4Ub, 4Lb).

As shown in FIG. 5C, the first warp pair (3Ub, 3Lb) has a first continuous knuckle site where the upper side warp binding yarn (3Ub) consecutively forms a plurality of knuckles on the upper side fabric with upper side wefts 8'U-9'U and 12'U-13'U (shown as the symbols "■" in FIG. 4) of a first group of upper side wefts 8'U through 13'U having center upper side wefts U10' and U11', and end upper side wefts 8'U and 13'U.

Another first warp pair (4UB, 4Lb) which is adjacent to the first warp pair above (3Ub, 3Lb) forms, as shown in FIG. 5D, consecutive knuckles on the upper side fabric at second continuous knuckle site where the upper side warp binding yarn (4Ub) consecutively forms a plurality of knuckles on the upper side fabric with upper side wefts 5'U, 7'U and 9'U (shown as the symbols "■" in FIG. 4) of a second group of upper side wefts 5'U through 9'U having a center upper side weft 7'U and end upper side wefts 5'U and 9'U.

At another second continuous knuckle site, the lower side warp binding yarn (4Lb) consecutively forms a plurality of knuckles on the upper side fabric with upper side wefts 11'U, 13'U, 15'U, 1'U and 3'U (shown as the symbols "▲" in FIG. 2) of another second group of upper side wefts 11'U through 3'U having a center upper side weft 15'U and end upper side wefts 11'U and 3'U.

The end upper side weft 9'U of the second group is adjacent to the center upper side weft 9'U of the first group. Another end upper side weft 11'U of the second group is the center upper side weft 11'U of the first group.

As shown in FIGS. 5C and 5D, when such a structure is employed, a stress in the first warp pair (3Ub and 3Lb) is applied in an upward direction at upper side wefts 10'U and 11'U as a peak (see wefts 5' and 6' of FIG. 1B) but in the warps of the first warp pair (4Ub and 4Lb) adjacent to the above-mentioned first warp pair, a stress is applied in a downward direction at upper side wefts 9'U and 11'U (see wefts 1' and 3' of FIG. 1A) so that the concave and convex thus formed can be offset by such a stress relationship between them.

Also, a downward stress formed by lower side binding yarn 3Lb and upper side binding yarn 3Ub at end upper side wefts 5'U and 8'U of FIG. 5C can be balanced by an upward stress formed by lower side binding yarn 4Lb at center upper side weft 7'U of FIG. 5D, so that a convex and a concave thus formed can also be off set. Likewise, a downward stress formed by upper side binding yarn 3Ub and lower side binding yarn 3Lb at end upper side wefts 13'U and 16'U of FIG. 5C can be balanced by an upward stress formed by lower side binding yarn 4Lb at center upper side weft 15'U of FIG. 5D, so that a convex and a concave thus formed can also be off set. This structure of the fabric makes it possible to prevent transfer of a dehydration mark of a fabric to paper and achieve good surface smoothness.

As shown in FIG. 5C, when such a structure is employed, a stress in the first warp pair (3Ub, 3Lb) is applied to an upward direction with upper side wefts 2'U and 3'U and 10'U and 11'U as peaks, while a stress in the first warp pair (4Ub, 4Lb) adjacent thereto (FIG. 5D) is applied in a downward direction so that a concave and a convex can be offset with each other by the stress relationship between them. Also in another warp pair, a convex and a concave occur but they are offset with a concave and a convex of the warp pair adjacent thereto, respectively. This makes it possible to prevent transfer of a dehydration mark of a fabric to paper and achieves good surface smoothness.

Embodiment 3

Figure 6:
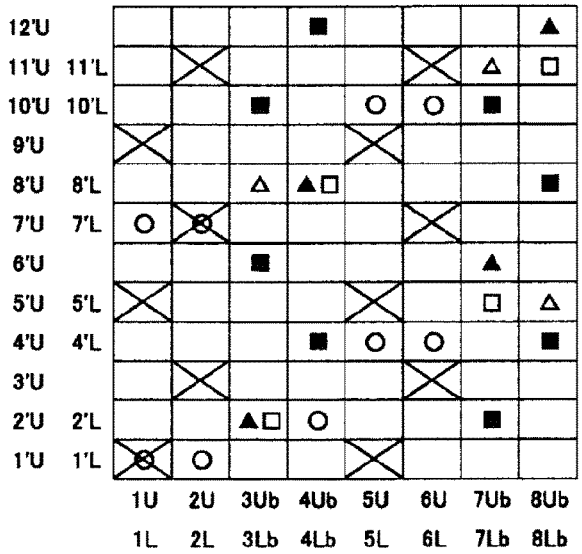
FIG. 6 is a design diagram showing a complete design or a repeating unit of Embodiment 3 according to the industrial two-layer fabric of the invention.

FIG. 6 is a design diagram showing a complete design or a repeating unit of Embodiment 3 according to the industrial two-layer fabric of the invention. The complete design has second warp pairs having no warp binding yarn and made of upper side warps (1U, 2U, 5U, and 6U) and lower side warps (1L, 2L, 5L, and 6L) and first warp pairs made of upper side warp binding yarns (3Ub, 4Ub, 7Ub, and 8Ub) and lower side warp binding yarns (3Lb, 4Lb, 7Lb, and 8Lb) each having a binding function. In the first warp pairs, two pairs, that is, a pair of 3Ub and 3Lb and a pair of 4Ub and 4Lb are adjacent to each other and two pairs, that is, a pair of 7Ub and 7Lb and a pair of 8Ub and 8Lb are adjacent to each other. Thus, the complete design has four first warp pairs. In the second warp pairs, two pairs, that is, a pair of 1U and 1L and a pair of 2U and 2L are adjacent to each other and two pairs, that is, a pair of 5U and 5L and a pair of 6U and 6L are adjacent to each other. Thus, the complete design has four second warp pairs. As shown in FIG. 6, two first warp pairs and two second warp pairs are alternately arranged and constitute a fabric having 16 shafts in total. The arrangement ratio of upper side wefts and lower side wefts is 3:2.

The warp binding yarn of the first warp pair is a warp having a binding function and it binds an upper side fabric and a lower side fabric by weaving with an upper side weft and a lower side weft. The upper side warp and the lower side warp of the second warp pair, on the other hand, are warps having no binding function.

Figure 7A:
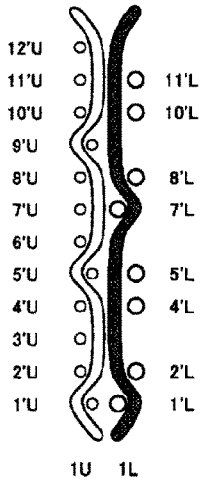
FIGS. 7A-7D are cross-sectional schematic views in a warp direction of Embodiment 3 shown in FIG. 6.
Figure 7B:
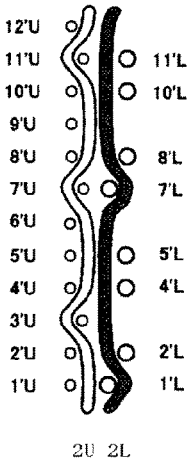

Described specifically, as shown in FIG. 7A, upper side warp 1U of the two warps of the second warp pair (1U, 1L) goes over upper side weft 1'U, goes under upper side wefts 2'U, 3'U, and 4U', goes over upper side weft 5'U, and so on. Lower side warp 1L goes under lower side wefts 1'L and 7'L. As shown in FIG. 7B, upper side warp 2U of the two warps of the second warp pair (2U, 2L) adjacent to second warp pair (1U, 1L) goes under upper side wefts 1'U and 2'U, goes over upper side weft 3'U, goes under upper side wefts 4'U, 5'U, and 6'U, and so on. Lower side warp 2L goes under lower side wefts 1'L and 7'L.

Figure 7C:
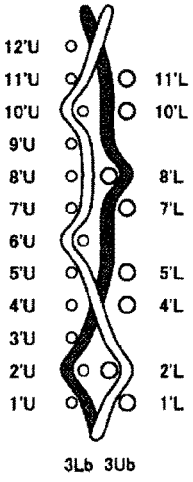
Figure 7D:
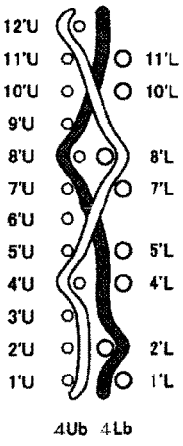

Next, as shown in FIG. 7C, lower side warp binding yarn 3Lb of the two warps of the first warp pair (3Ub and 3Lb) goes over neither of upper side wefts 6'U and 10'U over which it is supposed to go from the standpoint of the constitution of the fabric, but goes under lower side weft 8'L. On the other hand, upper side warp binding yarn 3Ub goes over upper side wefts 6'U and 10'U over which lower side warp binding yarn 3Lb is supposed to go, and go under lower side weft 2'L. As shown in FIG. 7D, lower side warp binding yarn 4Lb of the two warps of another first warp pair (4Ub and 4Lb) placed adjacent to the above-mentioned first warp pair goes over neither of upper side wefts 4'U and 12'U over which it is supposed to go but goes under lower side weft 2'L. On the other hand, upper side warp binding yarn 4Ub goes over upper side wefts 12'U and 4'U over which lower side warp binding yarn 4Lb is supposed to go and then goes under lower side weft 8'L. These warp binding yarns, together as a pair, form a design corresponding to one warp.

In this Embodiment 3, the first warp pair (3Ub and 3Lb) has sites (upper side wefts 6'U and 10'U) at which the upper side warp binding yarn (3Ub) constituting the first warp pair continuously forms a plurality of knuckles on the upper side fabric and at a site adjacent to the above-mentioned sites, placed is a non-continuous single knuckle (8'U) of the binding yarn of the first warp pair (4Ub and 4Lb) adjacent to the above-mentioned first pair.

In this Embodiment 3, as shown in FIG. 7C, the first warp pair (3Ub, 3Lb) has a first continuous knuckle site where the upper side warp binding yarn (3Ub) consecutively forms a plurality of knuckles on the upper side fabric with upper side wefts 6'U and 10'U (shown as the symbols "■" in FIG. 6) of a first group of upper side wefts 6'U through 10'U having a center upper side weft 8'U and end upper side wefts 6'U and 10'U.

Another first warp pair (4UB, 4Lb) which is adjacent to the first warp pair above (3Ub, 3Lb) forms, as shown in FIG. 7D, consecutive knuckles on the upper side fabric at second continuous knuckle site where the upper side warp binding yarn (4Ub) consecutively forms a plurality of knuckles on the upper side fabric with upper side wefts 12'U and 4'U (shown as the symbols "■" in FIG. 6) of a second group of upper side wefts 12'U through 4'U having a center upper side weft 2'U and end upper side wefts 12'U and 4'U.

At another second knuckle site, the lower side warp binding yarn (4Lb) forms a single knuckle on the upper side fabric with another second group of upper side weft 8'U (shown as the symbol "▲" in FIG. 6).

The upper side weft 8'U of the second group is the center upper side weft 8'U of the first group.

As shown in FIGS. 7C and 7D, when such a structure is employed, a stress in the first warp pair (3Ub,3Lb) is applied in an upward direction at upper side weft 8'U as a peak (see weft 7' of FIG. 1C) but in the warps of the first warp pair (4Ub and 4Lb) adjacent to the above-mentioned first warp pair, a stress is applied in a downward direction at upper side weft 8'U so that the concave and convex thus formed can be offset by such a stress relationship between them.

Also, a downward stress formed by lower side binding yarn 3Lb at an end upper side weft 2'U of FIG. 7C can be balanced by an upward stress formed by upper side binding yarn 4Ub at center upper side weft 2'U of FIG. 7D, so that a convex and a concave thus formed can also be off set. This structure of the fabric makes it possible to prevent transfer of a dehydration mark of a fabric to paper and achieve good surface smoothness.

Embodiment 4

Figure 8:
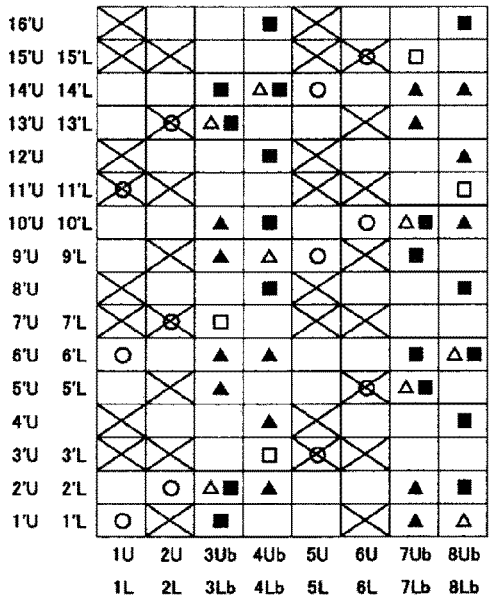
FIG. 8 is a design diagram showing a complete design or a repeating unit of Embodiment 4 according to the industrial two-layer fabric of the invention.

FIG. 8 is a design diagram showing a complete design of Embodiment 4 according to the industrial two-layer fabric of the invention. The complete design has second warp pairs having no warp binding yarn and made of upper side warps (1U, 2U, 5U, and 6U) and lower side warps (1L, 2L, 5L, and 6L) and first warp pairs made of upper side warp binding yarns (3Ub, 4Ub, 7Ub, and 8Ub) and lower side warp binding yarns (3Lb, 4Lb, 7Lb, and 8Lb) each having a binding function. In the first warp pairs, two pairs, that is, a pair of 3Ub and 3Lb and a pair of 4Ub and 4Lb are adjacent to each other and two pairs, that is, a pair of 7Ub and 7Lb and a pair of 8Ub and 8Lb are adjacent to each other. Thus, the complete design has four first warp pairs. In the second warp pairs, two pairs, that is, a pair of 1U and 1L and a pair of 2U and 2L are adjacent to each other and two pairs, that is, a pair of 5U and 5L and a pair of 6U and 6L are adjacent to each other. Thus, the complete design has four second warp pairs. As shown in FIG. 8, two first warp pairs and two second warp pairs are alternately arranged and constitute a fabric having 16 shafts in total. The arrangement ratio of upper side wefts and lower side wefts is 4:3.

The warp binding yarn of the first warp pair is a warp having a binding function and it binds an upper side fabric and a lower side fabric by weaving with an upper side weft and a lower side weft. The upper side warp and the lower side warp of the second warp pair, on the other hand, are warps having no binding function.

Figure 9A:
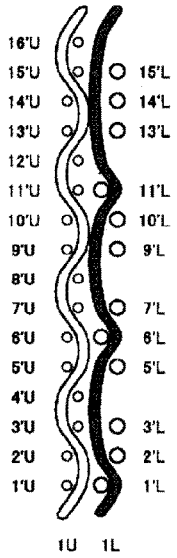
FIGS. 9A-9D are cross-sectional schematic views in a warp direction of Embodiment 4 shown in FIG. 8.
Figure 9B:
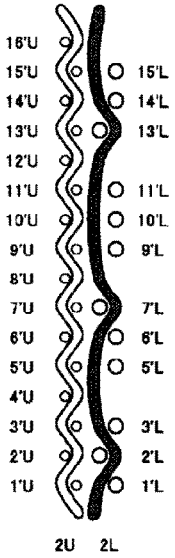

Described specifically, as shown in FIG. 9A, upper side warp 1U of the two warps of the second warp pair (1U, 1L) goes under upper side wefts 1'U and 2'U, goes over upper side wefts 3'U and 4'U, goes under upper side wefts 5'U and 6'U, and so on. Lower side warp 1L goes under lower side wefts 1'L, 6'L, and 11'L. As shown in FIG. 9B, upper side warp 2U of the two warps of the second warp pair (2U, 2L) adjacent to the second warp pair (1U, 1L) goes over upper side weft 1'U, goes under upper side weft 2'U, goes over upper side weft 3'U, goes under upper side weft 4'U, goes over upper side weft 5'U, and so on to form a plain weave. Lower side warp 2L goes under lower side wefts 2'L, 7'L, and 13'L.

Figure 9C:
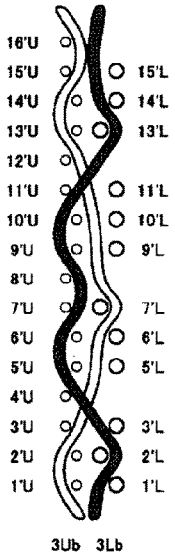
Figure 9D:
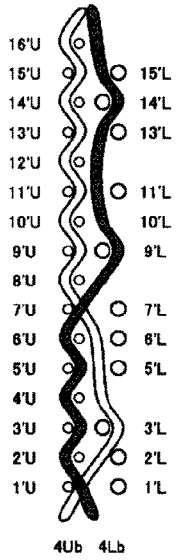

Next, as shown in FIG. 9C, upper side warp binding yarn 3Ub of the two warps of the first warp pair (3Ub and 3Lb) goes over none of upper side wefts 5'U, 6'U, 9'U, and 10'U over which it is supposed to go from the standpoint of the constitution of the fabric, but goes under lower side weft 7'L. On the other hand, lower side warp binding yarn 3Lb goes over upper side wefts 5'U, 6'U, 9'U, and 10'U over which upper side warp binding yarn 3Ub is supposed to go and then goes under lower side wefts 2'L and 13'L. As shown in FIG. 9D, upper side warp binding yarn 4Ub of the two warps of another first warp pair (4Ub, 4Lb) placed adjacent to the above-mentioned first warp pair goes over none of upper side wefts 2'U, 4'U and 6'U over which it is supposed to go from the standpoint of the constitution of plain weave but goes between upper side wefts 1'U and 2'U and lower side wefts 1'L and 2'L, goes under lower side weft 3'L, goes between upper side wefts 4'U, 5'U, and 6'U and lower side wefts 5'L and 6'L, and then goes over upper side wefts 8'U, 10'U, 12'U, 14'U, and 16'U. On the other hand, lower side warp binding yarn 4Lb goes over upper side wefts 2'U, 4'U, and 6'U over which upper side warp binding yarn 4Ub is supposed to go and then goes under lower side wefts 9'L and 14'L. Thus, these two warp binding yarns, together as a pair, form a plain weave design corresponding to one warp.

In the present Embodiment 4, the first warp pair (4Ub, 4Lb) has sites (upper side wefts 8'U, 10'U, 12'U, 14'U, and 16'U) at which the upper side warp binding yarn (4Ub) constituting the first warp pair continuously forms a plurality of knuckles on the upper side fabric and at a site adjacent to the above-mentioned sites, placed is a plurality of knuckles (9'U, 10'U, 13'U, and 14'U) of the binding yarn of the first warp pair (3Ub, 3Lb) adjacent to the above-mentioned first warp pair (4Ub, 4Lb).

In this Embodiment 4, as shown in FIG. 9C, the first warp pair (3Ub, 3Lb) has a first continuous knuckle site where the lower side warp binding yarn (3Lb) consecutively forms a plurality of knuckles on the upper side fabric with upper side wefts 5'U-6'U and 9'U-10'U (shown as the symbols "▲" in FIG. 8) of a first group of upper side wefts 5'U through 10'U having center upper side wefts 7'U and 8'U, and end upper side wefts 5'U and 10'U.

Another first warp pair (4UB, 4Lb) which is adjacent to the first warp pair above (3Ub, 3Lb) forms, as shown in FIG. 9D, consecutive knuckles on the upper side fabric at second continuous knuckle site where the upper side warp binding yarn (4Ub) consecutively forms a plurality of knuckles on the upper side fabric with upper side wefts 8'U, 10'U, 12'U, 14'U and 16'U (shown as the symbols "■" in FIG. 8) of a second group of upper side wefts 8'U through 16'U having a center upper side weft 12'U and end upper side wefts 8'U and 16'U.

At another second knuckle site, the lower side warp binding yarn (4Lb) forms consecutive knuckles on the upper side fabric with upper side wefts 2'U, 4'U and 6'U (shown as the symbol "▲" in FIG. 8) of another second group having a center upper side weft of 4'U and end upper side wefts 2'U and 6'U.

The end upper side weft 6'U of the second group (FIG. 9D) is adjacent to the center upper side weft 7'U of the first group (FIG. 9C). Another end upper side weft 8'U of the second group (FIG. 9D) is the center upper side weft 8'U of the first group (FIG. 9C).

As shown in FIGS. 9C and 9D, when such a structure is employed, a stress in the first warp pair (3Ub and 3Lb) is applied in an upward direction at upper side wefts 7'U and 8'U as a peak (see wefts 5' and 6' of FIG. 1B) but in the warps of the first warp pair (4Ub and 4Lb) adjacent to the above-mentioned first warp pair (3Ub and 3Lb), a stress is applied in a downward direction at upper side wefts 6'U and 8'U (see wefts 1' and 3' of FIG. 1A) so that the concave and convex thus formed can be offset by such a stress relationship between them.

Also, a downward stress formed by lower side binding yarn 3Lb and upper side binding yarn 3Ub at end upper side wefts 10'U and 13'U of FIG. 9C can be balanced by an upward stress formed by upper side binding yarn 4Ub at center upper side weft 12'U of FIG. 9D, so that a convex and a concave thus formed can also be off set. Likewise, a downward stress formed by upper side binding yarn 3Ub and lower side binding yarn 3Lb at end upper side wefts 2'U and 5'U of FIG. 9C can be balanced by an upward stress formed by lower side binding yarn 4Lb at center upper side weft 4'U, adjacent to the end upper side weft 5'U above, of FIG. 9D, so that a convex and a concave thus formed can also be off set. This structure of the fabric makes it possible to prevent transfer of a dehydration mark of a fabric to paper and achieve good surface smoothness.

Embodiment 5

Figure 10:
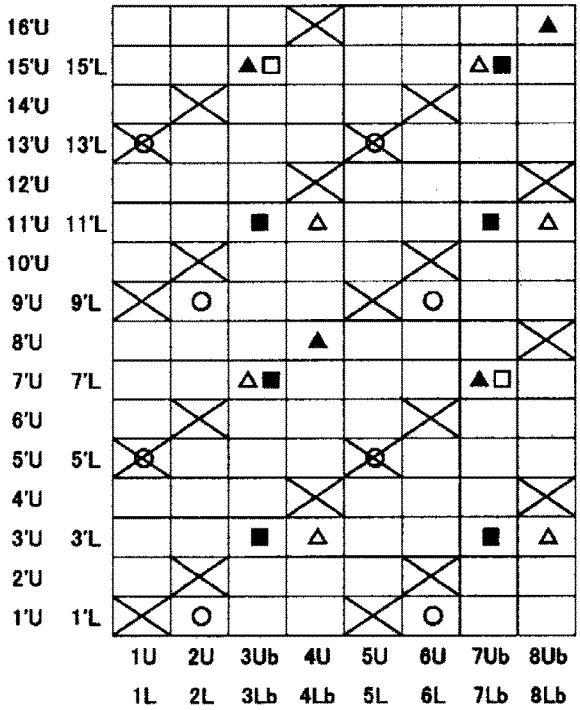
FIG. 10 is a design diagram showing a complete design or a repeating unit of Embodiment 5 according to the industrial two-layer fabric of the invention.

FIG. 10 is a design diagram showing a complete design or a repeating unit of Embodiment 5 according to the industrial two-layer fabric of the invention. The complete design has second warp pairs having no warp binding yarn and made of upper side warps (1U, 2U, 5U, and 6U) and lower side warps (1L, 2L, 5L, and 6L) and first warp pairs made of upper side warp binding yarns (3Ub, 4Ub, 7Ub, and 8Ub) and lower side warp binding yarns (3Lb, 4Lb, 7Lb, and 8Lb) each having a binding function. In the first warp pairs, two pairs, that is, a pair of 3Ub and 3Lb and a pair of 4Ub and 4Lb are adjacent to each other and two pairs, that is, a pair of 7Ub and 7Lb and a pair of 8Ub and 8Lb are adjacent to each other. Thus, the complete design has four first warp pairs. In the second warp pairs, two pairs, that is, a pair of 1U and 1L and a pair of 2U and 2L are adjacent to each other and two pairs, that is, a pair of 5U and 5L and a pair of 6U and 6L are adjacent to each other. Thus, the complete design has four second warp pairs. As shown in FIG. 10, two first warp pairs and two second warp pairs are alternately arranged and constitute a fabric having 16 shafts in total. The arrangement ratio of upper side wefts and lower side wefts is 2:1.

The warp binding yarn of the first warp pair is a warp having a binding function and it binds an upper side fabric and a lower side fabric by weaving with an upper side weft and a lower side weft. The upper side warp and the lower side warp of the second warp pair, on the other hand, are warps having no binding function.

Figure 11A:
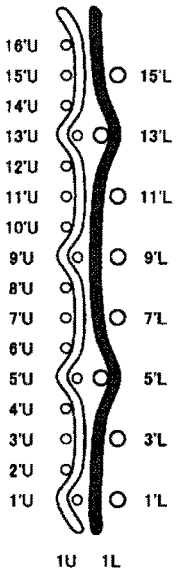
FIGS. 11A-11C are cross-sectional schematic views, in a warp direction, of Embodiment 5 shown in FIG. 10.

Described specifically, as shown in FIG. 11A, upper side warp 1U of the two warps of the second warp pair (1U, 1L) goes over upper side weft 1'U, goes under upper side wefts 2'U, 3'U, and 4'U, goes over upper side weft 5'U, and so on. Lower side warp 1L goes under lower side wefts 5'L and 13'L. Upper side warp 2U (see FIG. 10) of the two warps of the second warp pair (2U and 2L) adjacent to the second warp pair (1U, 1L) goes over upper side weft 2'U, goes under upper side wefts 3'U, 4'U, and 5'U, goes over upper side weft 6'U, and so on. Lower side warp 2L goes under lower side wefts 1'L and 9'L.

Figure 11B:
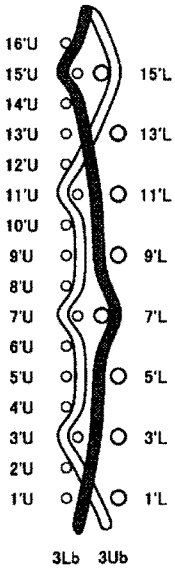
Figure 11C:
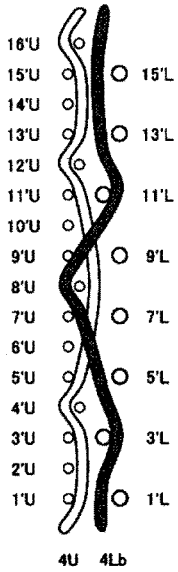

Next, as shown in FIG. 11B, lower side warp binding yarn 3Lb of the two warps of the first warp pair (3Ub, 3Lb) goes over none of upper side wefts 3'U, 7'U, and 11'U over which it is supposed to go from the standpoint of the constitution of the fabric, but goes under lower side weft 7'L. On the other hand, upper side warp binding yarn 3Ub goes over upper side wefts 3'U, 7'U, and 11'U over which lower side warp binding yarn 3Lb is supposed to go and then go under lower side weft 15'L. As shown in FIG. 11C, upper side warp 4U of the two warps of another first warp pair (4Ub, 4Lb) adjacent to the above-mentioned first warp pair (3Ub, 3Lb) does not go over upper side weft 8'U over which it is supposed to go from the standpoint of the constitution of the fabric but goes between the upper side weft and the lower side weft, and then goes over upper side wefts 12'U and 16'U. On the other hand, lower side warp binding yarn 4Lb goes over upper side weft 8'U over which upper side warp 4U is supposed to go and then goes under lower side wefts 11'L and 3'L. Thus, they, together as a pair, form a design corresponding to one warp.

In this Embodiment 5, the first warp pair (3Ub and 3Lb) has sites (upper side wefts 3'U, 7'U, and 11'U) at which the upper side warp binding yarn (3Ub) constituting the first warp pair continuously forms a plurality of knuckles on the upper side fabric and at a site adjacent to these sites, placed is a single non-continuous knuckle (8'U) of the binding yarn of the first warp pair (4Ub and 4Lb) adjacent to the above-mentioned first warp pair.

In this Embodiment 5, as shown in FIG. 11B, the first warp pair (3Ub, 3Lb) has a first continuous knuckle site where the upper side warp binding yarn (3Ub) consecutively forms a plurality of knuckles on the upper side fabric with upper side wefts 3'U, 7'U and 11'U (shown as the symbols "■" in FIG. 10) of a first group of upper side wefts 3'U through 11'U having a center upper side weft 7'U and end upper side wefts 3'U and 11'U.

The lower warp binding yarn 4Lb of another first warp pair (4U, 4Lb) which is adjacent to the first warp pair above (3Ub, 3Lb) forms, as shown in FIG. 11C, a knuckle on the upper side fabric at a second knuckle site with a second group of upper side weft 8'U (shown as the symbol "▲" in FIG. 6).

The upper side weft 8'U of the second group is adjacent to the center upper side weft 7'U of the first group.

As shown in FIGS. 11B and 11C, when such a structure is employed, a stress in the first warp pair (3Ub,3Lb) is applied in an upward direction at upper side weft 7'U as a peak (see weft 7' of FIG. 1C) but in the warps of the first warp pair (4U and 4Lb) adjacent to the above-mentioned first warp pair, a stress is applied in a downward direction at upper side weft 8'U so that the concave and convex thus formed can be offset by such a stress relationship between them. This makes it possible to prevent transfer of a dehydration mark of a fabric to paper and achieve good surface smoothness.

Embodiment 6

Figure 12:
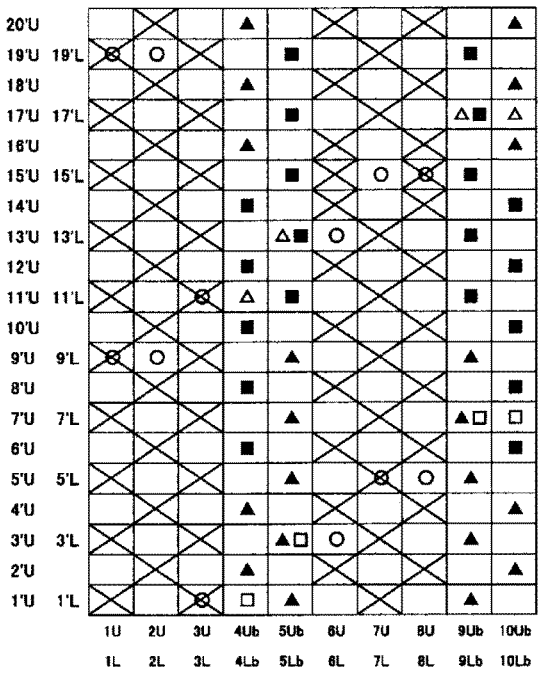
FIG. 12 is a design diagram showing a complete design or a repeating unit of Embodiment 6 according to the industrial two-layer fabric of the invention.

FIG. 12 is a design diagram showing a complete design or a repeating unit of Embodiment 6 according to the industrial two-layer fabric of the invention. The complete design has second warp pairs having no warp binding yarn and made of upper side warps (1U, 2U, 3U, 6U, 7U, and 8U) and lower side warps (1L, 2L, 3L, 6L, 7L, and 8L) and first warp pairs made of upper side warp binding yarns (4Ub, 5Ub, 9Ub, and 10Ub) and lower side warp binding yarns (4Lb, 5Lb, 9Lb, and 10Lb) each having a binding function. In the first warp pairs, two pairs, that is, a pair of 4Ub and 4Lb and a pair of 5Ub and 5Lb are adjacent to each other and two pairs, that is, a pair of 9Ub and 9Lb and a pair of 10Ub and 10Lb are adjacent to each other. Thus, the complete design has four first warp pairs. In the second warp pairs, three pairs, that is, a pair of 1U and 1L, a pair of 2U and 2L, and a pair of 3U and 3L are adjacent to one another and three pairs, that is, a pair of 6U and 6L, a pair of 7U and 7L, and a pair of 8U and 8L are adjacent to one another. Thus, the complete design has six second warp pairs. As shown in FIG. 12, the two first warp pairs and the three second warp pairs are alternately arranged and constitute a fabric having 20 shafts in total. The arrangement ratio of upper side wefts and lower side wefts is 2:1.

The warp binding yarn of the first warp pair is a warp having a binding function and it binds an upper side fabric and a lower side fabric by weaving with an upper side weft and a lower side weft. The upper side warp and the lower side warp of the second warp pair, on the other hand, are warps having no binding function.

Figure 13A:
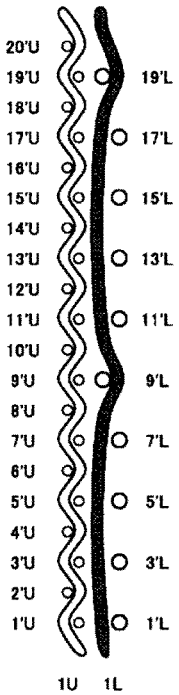
FIGS. 13A-13C are a cross-sectional schematic views in a warp direction of Embodiment 6 shown in FIG. 12.

Described specifically, as shown in FIG. 13A, upper side warp 1U of the two warps of the second warp pair (1U and 1L) goes over upper side weft 1'U, goes under upper side weft 2'U, and so on to form a plain weave. Lower side warp 1L goes under lower side wefts 9'L and 19'L.

Figure 13B:
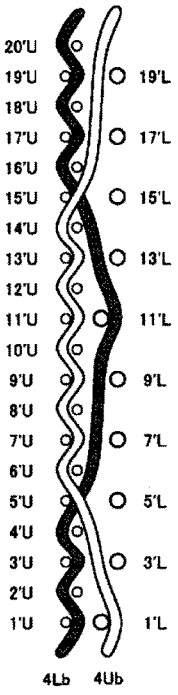

Next, As shown in FIG. 13B, lower side warp binding yarn 4Lb of the two warps of the first warp pair (4Ub, 4Lb) goes over none of upper side wefts 6'U, 8'U, 10'U, 12'U, and 14'U over which it is supposed to go from the standpoint of the constitution of the plain weave in the fabric but goes between upper side wefts from 5'U to 10'U and lower side wefts 5'L, 7'L, and 9'L, goes under lower side weft 11'L, goes between upper side wefts from 12'U to 15'U and lower side wefts 13'L and 15'L, and then goes over upper side wefts 16'U, 18'U, and 20'U. On the other hand, upper side warp binding yarn 4Ub goes over upper side wefts 6'U, 8'U, 10'U, 12'U, and 14'U over which lower side warp binding yarn 4Lb is supposed to go, and then goes under lower side weft 1'L. These warp binding yarns, together as a pair, form a plain weave design corresponding to one warp.

Figure 13C:
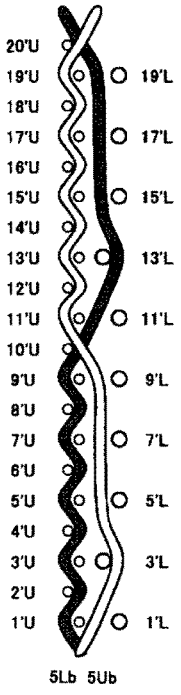

As shown in FIG. 13C, lower side warp 5Lb of the two warps of another first warp pair (5Ub, 5Lb) placed adjacent to the above-mentioned first warp pair (4Ub and 4Lb) goes over none of upper side wefts 11'U, 13'U, 15'U, 17'U, and 19'U over which it is supposed to go from the standpoint of the constitution of the plain weave of the fabric but goes between the upper side weft and the lower side weft, and then goes under lower side weft 13'L. On the other hand, upper side warp binding yarn 5Ub goes over upper side wefts 11'U, 13'U, 15'U, 17'U, and 19'U over which lower side warp binding yarn 5Lb is supposed to go and then goes under lower side weft 3'L. Thus, these two warps, together as a pair, form a plain weave design corresponding to one warp.

In this Embodiment 6, the first warp pair (4Ub, 4Lb) has sites at which the upper side warp binding yarn (4Ub) and the lower side warp binding yarn (4Lb) constituting the first warp pair continuously form a plurality of knuckles on the upper side fabric. Such a weave structure has convex shapes with the wefts 11'U and 20'U located at the center of these sites as peaks, respectively. At sites adjacent to them, however, end portions (11'U and 20'U) of a continuous plurality of knuckles of the binding yarns of the first warp pair (5Ub, 5Lb) are placed.

In this Embodiment 6, as shown in FIG. 13B, the first warp pair (4Ub, 4Lb) has a first continuous knuckle site where the upper side warp binding yarn (4Ub) consecutively forms a plurality of knuckles on the upper side fabric with upper side wefts 6'U, 8'U, 10'U, 12'U and 14'U (shown as the symbols "■" in FIG. 12) of a first group of upper side wefts 6'U through 12'U having a center upper side weft 9'U and end upper side wefts 6'U and 12'U.

Another first warp pair (5UB, 5Lb) which is adjacent to the first warp pair above (4Ub, 4Lb) forms, as shown in FIG. 13C, consecutive knuckles on the upper side fabric at second continuous knuckle site where the upper side warp binding yarn (5Ub) consecutively forms a plurality of knuckles on the upper side fabric with upper side wefts 11'U, 13'U, 15'U, 17'U and 19'U (shown as the symbols "■" in FIG. 12) of a second group of upper side wefts 11'U through 19'U having a center upper side weft 15'U and end upper side wefts 11'U and 19'U.

At another second continuous knuckle site, the lower side warp binding yarn (5Lb) consecutively forms a plurality of knuckles on the upper side fabric with upper side wefts 1'U, 3'U, 5'U, 7'U and 9'U (shown as the symbols "▲" in FIG. 12) of another second group of upper side wefts 1'U through 9'U having a center upper side weft 5'U and end upper side weft 1'U and 9'U.

The end upper side weft 9'U of the second group is the center upper side weft 9'U of the first group.

As shown in FIGS. 13B and 13C, when such a structure is employed, a stress in the first warp pair (4Ub, 4Lb) is applied in an upward direction at upper side weft 9'U as a peak (see weft 2' of FIG. 1A) but in the warps of the first warp pair (5Ub, 5Lb) adjacent to the above-mentioned first warp pair (4Ub, 4Lb), a stress is applied in a downward direction at the end upper side wefts 9'U and 11'U (see wefts 1' and 3' of FIG. 1A) so that the concave and convex thus formed can be offset by such a stress relationship between them.

Also, a downward stress formed by lower side binding yarn 4Lb and upper side binding yarn 4Ub at end upper side wefts 4'U and 6'U of FIG. 13B can be balanced by an upward stress formed by lower side binding yarn 5Lb at center upper side weft 5'U of FIG. 13C, which is adjacent to the end upper side wefts 4'U and 6'U of FIG. 13B, so that a convex and a concave thus formed can also be off set. Likewise, a downward stress formed by upper side binding yarn 4Ub and lower side binding yarn 4Lb at end upper side wefts 14'U and 16'U of FIG. 13B can be balanced by an upward stress formed by upper side binding yarn 5Ub at center upper side weft 15'U of FIG. 13C, which is adjacent to the end upper side wefts 14'U and 16'U of FIG. 13B, so that a convex and a concave thus formed can also be off set. This structure of the fabric makes it possible to prevent transfer of a dehydration mark of a fabric to paper and achieve good surface smoothness.

Comparative Example 1

Figure 14:
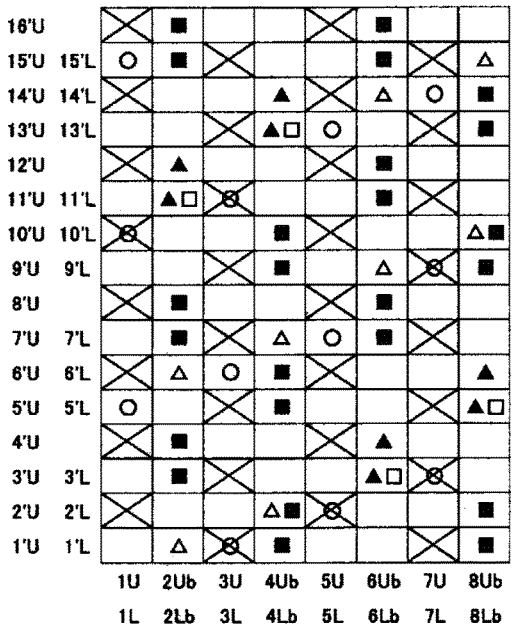
FIG.14 Related Art
FIG. 14 is a design diagram showing a complete design or a repeating unit of Comparative Example 1 according to an industrial two-layer fabric of a related art.

FIG. 14 is a design diagram showing a complete design or a repeating unit of Comparative Example 1 showing one example of a conventional industrial two-layer fabric. Such a conventional industrial two-layer fabric has four pairs having no warp binding yarn and comprised of upper side warps (1U, 3U, 5U, and 7U) and lower side warps (1L, 3L, 5L, and 7L); and four pairs comprised of upper side warp binding yarns (2Ub, 4Ub, 6Ub, and 8Ub) and lower side warp binding yarns (2Lb, 4Lb, 6Lb, and 8Lb), each having a binding function. The pairs of an upper side warp and a lower side warp and the pairs of binding yarns are arranged alternately. An arrangement ratio of upper side wefts and lower side wefts is 4:3.

Figure 15A:
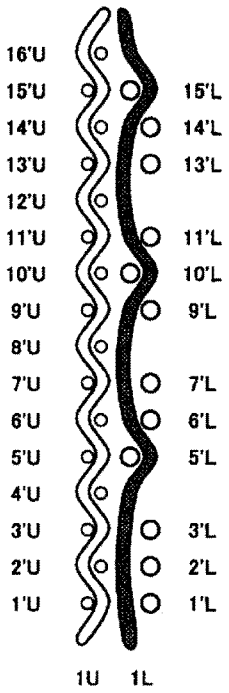
FIG.15A Related Art
FIGS. 15A-15C are a cross-sectional schematic views in a warp direction of Comparative Example 1 shown in FIG. 14.
Figure 15B:
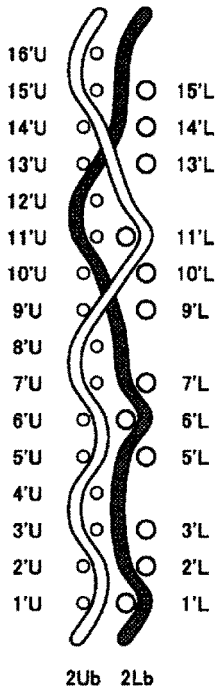
FIG.15B Related Art
Figure 15C:
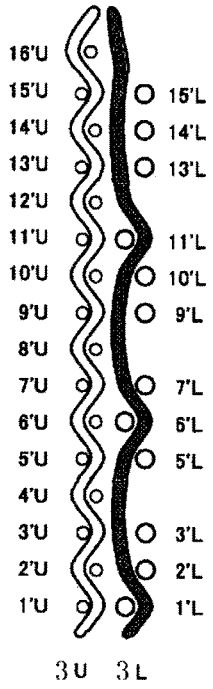
FIG.15C Related Art

Described specifically, as shown in FIG. 15, upper side warp 1U, which belongs to the pairs of an upper side warp and a lower side warp, goes over upper side wefts 2'U, 4'U, and so on to form a plain weave. Lower side warp 1L goes under lower side wefts 5'L, 10'L, and 15'L.

Upper side warp binding yarn 2Ub of the binding yarn pair (2Ub and 2Lb) adjacent to the pair (1U and 1L) of an upper side warp and a lower side warp goes over neither of upper side wefts 11'U and 12'U over which it is supposed to go from the standpoint of the constitution of the fabric but goes under lower side weft 11'L. On the other hand, lower side warp binding yarn 2Lb goes over upper side wefts 11'U and 12'U over which upper side warp binding yarn 2Ub is supposed to go and then goes under lower side wefts 1'L and 6'U.

Adjacent to the pair, the pair (3U, 3L) of an upper side warp and a lower side warp is placed. This pair has a design similar to that of the above-mentioned pair (1U, 1L).

In such a conventional industrial two-layer fabric structure, the binding yarn pair (2Ub and 2Lb) has a convex shape with upper side wefts 3'U and 4'U as a peak. In addition, a stress is applied to upper side wefts 11'U and 12'U in a downward direction so that a convex and concave shape appears. On the other hand, the upper side warp pairs (1U and 1L, and 3U and 3L) adjacent to the binding yarn pair have a plain weave design so that a particular stress in an upward or downward direction does not occur. It is therefore impossible to offset a stress which has occurred in the binding yarn pair with a weave constitution of the warp pair adjacent thereto. The conventional fabric having convex protrusions arranged uniformly as described above causes dehydration marks in paper making and has poor surface smoothness.

Figure 16B:
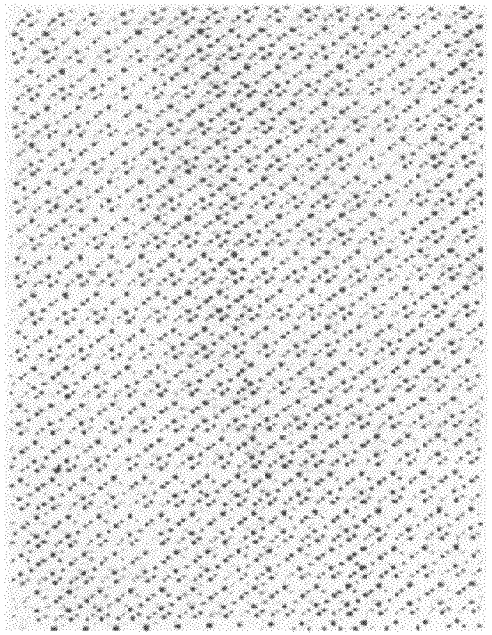
Figure 16A:
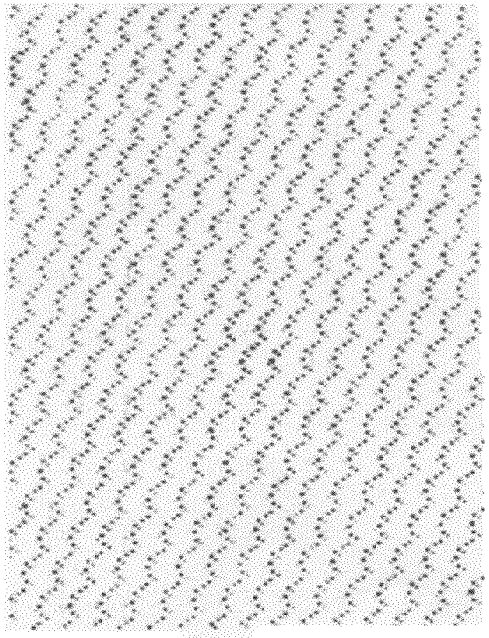

FIGS. 16A and 16B each shows a surface transfer mark of an upper side surface of the industrial two-layer fabrics according to Comparative Example 1 and Embodiment 1 respectively, in which FIG. 16A shows an upper side surface of the industrial two-layer fabric according to Comparative Example 1 and FIG. 16B is an upper side surface of the industrial two-layer fabric according to Embodiment 1.

Portions which have appeared black in these drawings are convex portions formed on the surface of the fabric. As shown in FIG. 16A, in the industrial two-layer fabric according to Comparative Example 1, transfer marks continuously appear in an oblique direction. On the other hand, in the industrial two-layer fabric according to Embodiment 1, as shown in FIG. 16B, black dots are dispersed uniformly and transfer marks arranged in an oblique direction cannot be found compared with Comparative Example 1. It is therefore apparent from FIGS. 16A and 16B that compared with the conventional industrial two-layer fabric, the industrial two-layer fabric according to Embodiment 1 has a marked effect for improving surface smoothness without increasing the mesh thickness because transfer of dehydration marks to paper is suppressed.

The preceding description has been presented only to illustrate and describe exemplary embodiments of the present industrial two-layer fabric. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An industrial two-layer fabric of 16 or more shafts comprising an upper side fabric having upper side warps and upper side wefts and a lower side fabric having lower side warps and lower side wefts, the upper side fabric and the lower side fabric are bound by binding yarns, comprising:

a first warp pair consisting of a binding yarn and one of an adjacent upper side warp, an adjacent lower side warp and an adjacent binding yarn;

a second warp pair consisting of an upper side warp and an adjacent lower side warp;

wherein, in a complete design, two or more of the first warp pairs are placed adjacent to each other, and two or more of the second warp pairs are placed adjacent to each other, wherein:

a first binding yarn of one of the first warp pairs forms consecutive knuckles on the upper side fabric with a first group of upper side wefts, the first group includes a center upper side weft located at a center of the first group, a second binding yarn of another one of the first warp pairs adjacent to the one of the first warp pairs forms consecutive knuckles on the upper side fabric with a second group of upper side wefts, the second group includes an end upper side weft located at an end of the second group, wherein the end upper side weft is the center upper side weft or an upper side weft of the first group adjacent to the center upper side weft.

2. The industrial two-layer fabric according to claim 1, wherein the first warp pair consists of the two binding yarns.

3. The Industrial two-layer fabric according to claim 1, wherein one of the first warp pairs consists of the two binding yarns, and another one of the first warp pairs adjacent to the one of the first warp pairs consists of the binding yarn and either one of the adjacent upper side warp and the adjacent lower side warp.

4. The industrial two-layer fabric according to claim 1, wherein in the two or more first warp pairs placed adjacent to each other, all the warps constituting the first warp pairs are binding yarns.

5. The industrial two-layer fabric according to claim 1, comprising four or more of the first warp pairs and four or more of the second warp pairs in the complete design.

6. The industrial two-layer fabric according to claim 5, comprising four of the first warp pairs and six of the second warp pairs in the complete design.

7. The industrial two-layer fabric according to claim 1, wherein another warp binding yarn of the one of the first warp pairs passes under a lower side weft below the center upper side weft upper side weft or the upper side weft adjacent to the center upper side weft.

8. The industrial two-layer fabric according to claim 7, wherein the first warp pair consists of the two binding yarns.

9. The Industrial two-layer fabric according to claim 7, wherein one of the first warp pairs consists of the two binding yarns, and another one of the first warp pairs adjacent to the one of the first warp pairs consists of the binding yarn and either one of the adjacent upper side warp and the adjacent lower side warp.

10. The industrial two-layer fabric according to claim 7, wherein in the two or more first warp pairs placed adjacent to each other, all the warps constituting the first warp pairs are binding yarns.

11. The industrial two-layer fabric according to claim 7, comprising four or more of the first warp pairs and four or more of the second warp pairs in the complete design.

12. The industrial two-layer fabric according to claim 11, comprising four of the first warp pairs and six of the second warp pairs in the complete design.

* * * * *